United States Patent [19]

Dittmann

[11] Patent Number: 4,734,668

[45] Date of Patent: Mar. 29, 1988

[54] ELECTROMAGNETIC RELAY

[75] Inventor: Michael Dittmann, Berlin, Fed. Rep. of Germany

[73] Assignee: Siemens Aktiengesellschaft, Berlin and Munich, Fed. Rep. of Germany

[21] Appl. No.: 46,034

[22] Filed: May 1, 1987

[30] Foreign Application Priority Data

May 12, 1986 [DE] Fed. Rep. of Germany ..... 3615948
Mar. 9, 1987 [DE] Fed. Rep. of Germany ..... 3707502

[51] Int. Cl.[4] ..... H01H 62/02

[52] U.S. Cl. ..... 335/128; 335/78; 335/203

[58] Field of Search ..... 335/78, 79, 80, 81, 335/82, 83, 84, 85, 124, 128, 129, 130, 132, 203, 278, 279

[56] References Cited

U.S. PATENT DOCUMENTS 3,211,854 10/1965 Bengtsson ..... 335/202
3,781,729 12/1973 Hayden ..... 335/203
4,267,540 5/1981 Iketani ..... 335/128
4,322,700 3/1982 Everhart et al. ..... 335/202
4,346,359 8/1922 Pirner et al. ..... 335/128
4,684,909 8/1987 Dittmann ..... 335/128

FOREIGN PATENT DOCUMENTS 2021455 11/1971 Fed. Rep. of Germany .
2532527 10/1977 Fed. Rep. of Germany .

*Primary Examiner*—E. A. Goldberg
*Assistant Examiner*—Lincoln Donovan
*Attorney, Agent, or Firm*—Hill, Van Santen, Steadman & Simpson

[57] ABSTRACT

A relay includes a coil body having a pair of flanges, a U-shaped core yoke, a flat armature, and at least one cooperating contact element anchored in the coil body. An angled leaf spring is secured to the armature, the leaf spring having an extension forming a contact spring and being simultaneously secured to said yoke by a U-shaped adjustment piece which serves as a bearing spring for the armature. All terminal elements are formed as tabs and are conducted downwardly out of the relay in a common plane perpendicular to the plane of integration of the relay so that an extremely narrow structure is provided.

32 Claims, 18 Drawing Figures

10
8
10c
25
14a
7
6
14
VI
VII
VIII
25a
19
18
16
3
2
25
1
29
28
22
5
18b
19b
21

ELECTROMAGNETIC RELAY

BACKGROUND OF THE INVENTION

1. Field of the Invention

The present invention is directed to an electromagnetic relay having a winding applied to a coil member between two flanges, and including a U-shaped flat core-yoke with a first leg extending through the coil member to form a core and a second leg extending outside the coil to form a yoke, a plateshaped armature being seated at a free end of the yoke to form an air gap with a free end of the core.

2. Description of the Related Art

A relay is disclosed in German Published Application No. 20 21 455, which is used as a power current relay and is formed of a coil member/magnetic circuit and a contact carrier unit. Although the disclosed relay is relatively flat, it nevertheless still requires a large structural volume due to the design of the coil member which includes, on one hand, the magnetic circuit and, on the other hand, the contact carrier unit and their subsequent joining. The disclosed relay also requires a relatively great number of discrete parts and work steps during manufacture. Moreover, the coil and contact terminal elements are provided in two rows so that a minimum structural width is prescribed by the spacings of the rows of terminal elements.

SUMMARY OF THE INVENTION

An object of the present invention is to provide a relay which is extremely narrow at least in one direction and which can be manufactured with few, simple parts by automatic fabrication. Furthermore, the relay of the invention is used for other purposes without altering the basic structure.

In accordance with the invention, this and other objects are achieved in a relay having a coil axis extending parallel to a plane of integration and a yoke arranged above the coil winding. A leaf spring forms a contact spring with a section extending beyond a free end of an armature and connected in electrically conductive fashion to a terminal element. Plug-in terminals for fastening coil terminal elements, and at least one cooperating contact element, are provided in the coil member. All of the terminal elements extend outward from the relay in a single plane perpendicular to the plane of integration of the relay.

In a relay of the invention, thus, the cooperating contact elements are accommodated in the coil member itself, just as are the coil terminal elements. The movable contact spring is directly connected to the armature and simultaneously forms its bearing spring. Thus, the number of parts in the present relay is kept low, since neither a separate contact carrier nor an actuating slide are required. As a result of the arrangement of all terminal elements of the relay in a single row, an especially narrow structure is provided so that the relay can be accommodated in a single row plug-in socket of very small width.

In a preferred embodiment, the angled leaf spring has a leg parallel to the yoke, secured to the yoke by a U-shaped adjustment member. The U-shaped adjustment member, in turn, has a first leg secured flat to the yoke and a second leg which carries the leaf spring and is staggered relative to the yoke at a prescribed bias angle. Accordingly, the armature and its leaf spring are secured to the yoke during automatic manufacturing steps. It is also possible to provide extremely precise adjustment of the bias angle with the adjustment member.

To position and fix the yoke, the coil flange expediently includes walls lengthened relative to the upper side of the relay having guide slots for the yoke. In an expedient development, that coil flange facing the armature includes a plug-in shaft in the region of the contact spring for accepting a make-contact cooperating contact element. Plug-in shafts for accepting the coil terminal elements are provided in the coil flange opposite the armature. The terminal element for the contact spring is expediently arranged in the region under the coil winding. For providing an electrical connection between the leaf spring and the appertaining terminal element, the leaf spring forms an additional terminal section at a portion connected to the yoke, the additional terminal section proceeding up to the terminal element and laterally embracing the coil winding. In another embodiment, however, an electrical connection in the form of a stranded conductor is provided immediately between the contacting portion of the leaf spring and the terminal element.

In an advantageous development, the coil flange opposite the armature includes an extension having recesses for accepting a further terminal element for a second cooperating contact element. The second cooperating contact element is guided up to the contact spring in guide shafts in both flanges. This forms a switch-over relay without modifying the basic structure of the relay. One flange of the coil member is merely lengthened somewhat to be able to accommodate an additional terminal element for the second cooperating contact element. The second cooperating contact element is plugged through both flanges parallel to the coil axis. The overall structure of the coil member and the magnet system, thus, remain the same as in the case of a simple make-contact relay. The narrow structure of the present relay is not lost, since the additional terminal element also lies in the same plane as the other terminal elements. Since the second cooperating contact element extends next to the coil winding, as well as next to the terminal element for the contact spring and next to the coil terminal elements, the seoond cooperating contact element is insulated from the electrically conductive parts by one or more insulating foils.

In a preferred embodiment, the relay is enclosed within a two-part housing. The parting plane between the two housing halves, or parts, lies in the plane of the terminal elements, and the terminal elements are aligned in corresponding guide channels in the housing halves. When the terminal elements are affixed to the coil member, the housing provides an additional support and guidance; however, for other terminal elements, such as for the contact spring, the housing provides the entire support and alignment means. Lateral gripping depressions are formed into the housing halves for better manipulation of the relay during plug-in and pull-out operations with a socket, the gripping depressions utilizing the free space between the housing and the coil winding.

Furthermore, additional solder supporting regions in the form of pluggable sheet metal angles are provided in the coil flange which carries the coil terminal elements. Additional component parts, such as resistors and diodes, can thereby be connected in parallel to or in series with the coil winding. Moreover, in one embodiment, an adhesion magnet is arranged at the coil flange facing the armature to damp the vibrations of the armature and thereby prevent chattering at the break-contact to assure adequate break-contact force. In a changeover, or make-contact, arrangement, the magnet causes a delayed response of the relay which results in a faultless pull-through of the armature. Thus, creeping contact is avoided.

It is further provided in an advantageous embodiment that all individual parts of the relay are connected to the coil member by being plugged-in in a straight line. This assures that all the terminal elements are in a stable position after mounting at the coil member and need not be stabilized by the housing.

At least a part of the end sections plugged into the coil member are anchored therein by barbs. In this embodiment, the armature is secured to a connecting angle by a leaf spring. The connecting angle is fashioned as a terminal element in a portion proceeding essentially perpendicular to the connecting plane and carries the leaf spring in a portion lying essentially horizontal, parallel to the yoke.

The coil terminals are formed of a plate, or plate bar, which includes clearances, or openings, by which the coil terminals are plugged onto corresponding male members extending from the coil body, the coil terminals being insulated from one another by cutting out a web therebetween. The male members can be heat deformed for fusing or affixing the coil terminals to the coil member. Moreover, cut-out webs of the plate can be bridged by electrical component parts, such as diodes or resistors, which can be connected in series or in parallel to the relay winding.

In a further development, the coil member carries an additional U-shaped flux plate which encloses the armature, together with the core end, in the reqion of the one coil flange, and thus, forms a second working air gap. In the region of the opposite coil flange, the flux plate encloses a permanent magnet together with the core yoke. When the permanent magnet is correspondingly magnetized, the relay has bistable switching behavior.

BRIEF DESCRIPTION OF THE DRAWINGS

FIG. 12 is an exploded view of a coil member of the relay of FIG. 11 showing how some parts are to be plugged in;

DESCRIPTION OF THE PREFERRED EMBODIMENTS

Figure 1:
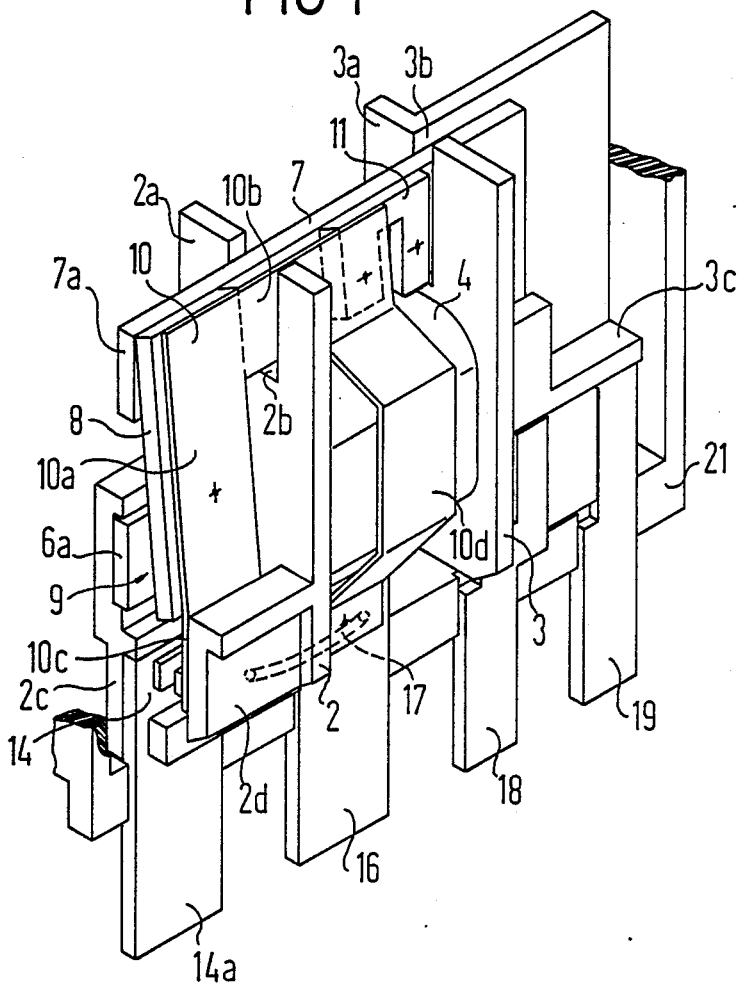
FIG. 1 is a perspective view of a make-contact relay according to the principles of the present invention.
Figure 2:
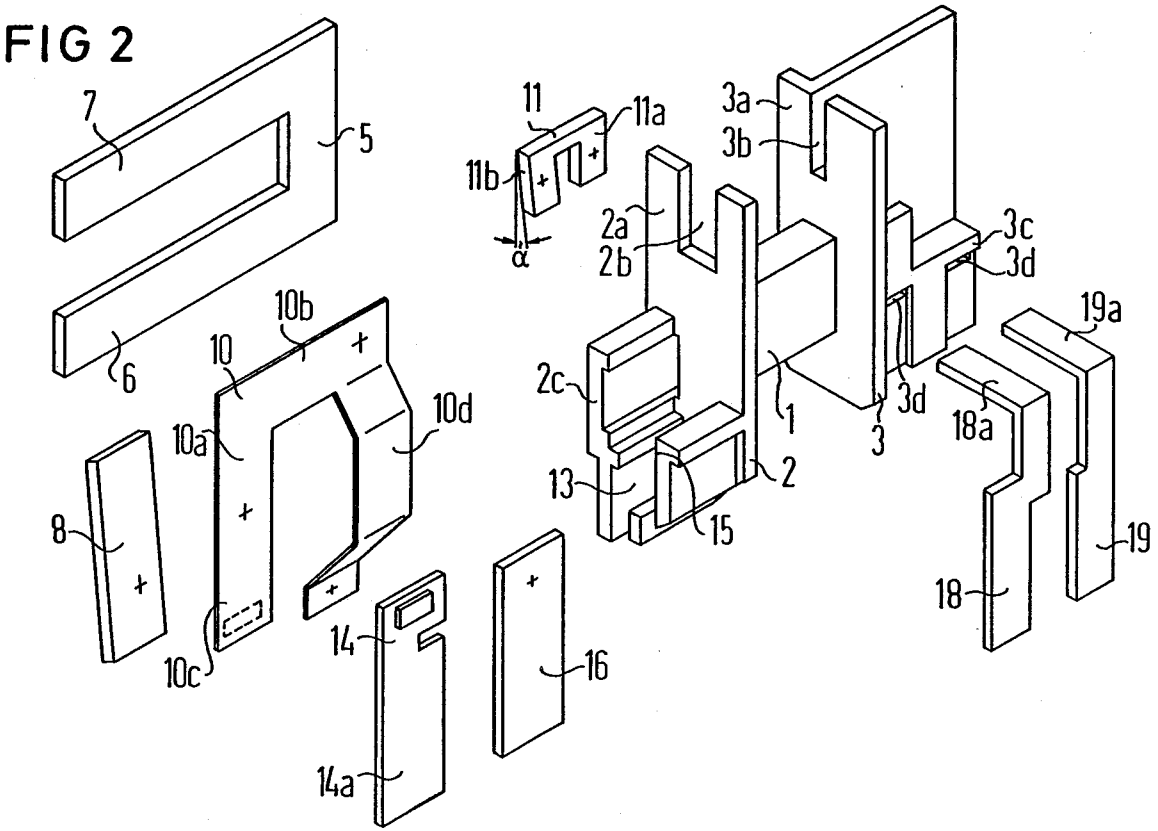
FIG. 2 is an exploded view of individual parts of the relay of FIG. 1.
Figure 3:
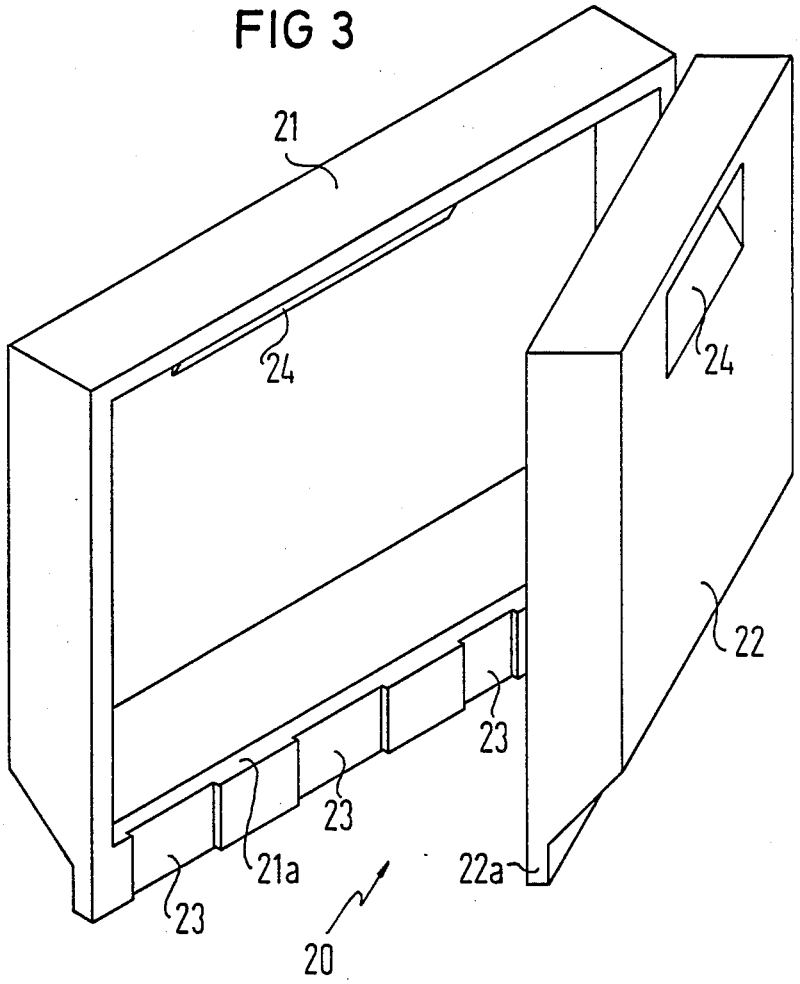
FIG. 3 is a perspective view of a two-part housing for the relay of FIG. 1.

A relay is shown in FIGS. 1, 2, and 3 having a coil member 1 as its carrying element that includes two flanges 2 and 3 between which is applied a winding 4. A U-shaped core Yoke 5 is plugged into the coil member 1 so that a lower leg thereof forms the core 6 extending through the coil in an axial direction and an upper leg thereof forms a yoke 7 extending above the winding 4 parallel to the coil axis. A flat armature 8 is seated at a free end section 7*a* of the yoke 7. The flat armature 8 forms a working air gap 9 with a free end section 6*a* of the core 6.

An angled leaf spring 10 bears the armature 8. A first leg 10*a* of the leaf spring 10 rests on the armature 8 and is connected thereto, while a second leg 10*b* extends essentially parallel to the yoke 7, yet at a desired bias angle relative to the plane of the yoke 7 to achieve a defined bias of the armature 8 in its quiescent condition. A U-shaped adjustment piece 11 defines the bias angle; the adjustment piece 11 having a first leg 11*a* lying on and being secured to the yoke 7, and having a second leg 11*b* jogged relative to the yoke plane and relative to the leg 11*a* by a desired bias angle $\alpha$. The armature bias, also known as the quiescent contacting force of the relay, can be adjusted after assembly of the relay by bending of the leg 11*b* relative to the leg 11*a*.

The two coil flanges 2 and 3 form upwardly extending walls 2*a* and 3*a* in which slots 2*b* and 3*b* are provided, respectively. The slot 3*b* is narrower and corresponds to the width of the yoke 7, serving to position the yoke; whereas the other slot 2*b* is wider and forms a single sided seat for the yoke 7. The wider slot 2*b* also enables the armature spring 10 to move therein. In addition, the coil flanges 2 and 3 are provided with continuations and recesses toward the relay ends to accept the remaining function parts of the relay. In particular, a plug-in shaft 13 for accepting a make-contact cooperating contact element 14 is provided in a continuation portion 2*c* of the coil flange 2. The quiescent position of a contact spring 10*c*, which is formed by a lengthened portion of the leaf spring 10, is defined by a stop 15 also formed by part of the flange 2, which thus sets the contacting distance or working air gap.

The cooperating contact element 14 has a terminal element 14*a* extending downwardly out of the relay in the shape of a tab. A terminal element 16 for the contact spring 10*c* also lies in the same plane. The electrical connection between the leaf spring 10 and the terminal element 16 is provided by another spring leg 10*d* which branches off downwardly from the spring leg 10*b* and is wrapped about one side of the coil winding 4 for connection to the terminal element 16. The connection between the terminal element 16 and the spring leg 10*d* can be accomplished by welding, soldering, or some other connection means. In place of the spring leg 10*d*, an electrical connection can be provided between the contact spring 10*c* and the terminal 16 by a stranded conductor. An example of the stranded conductor is shown in phantom at 17 in FIG. 1. One end of the stranded conductor 17 is directly welded to the contact spring 10*c* and the other end is welded to the terminal element 16. Of course, that portion of the coil member referenced 2*d* in FIG. 1 would have to be either entirely or partially omitted so that the stranded conductor 1 could be connected to the contact spring 10*c*.

The coil flange 3 includes a continuation 3*c* and cross channels 3*d* into which coil terminal elements 18 and 19 are plugged in. The coil terminal elements 18 and 19 are formed of tabs and have angled portions 18*a* and 19*a*, respectively, plugged through the coil member continuation 3*c*. The winding ends of the coil winding 4 are applied to free ends 18*b* and 19*b* of the angled sections 18*a* and 19*a*, preferably by soldering thereto. The free ends 18*b* and 19*b*, respectively, can be bent up or down in accordance with the illustration of FIG. 6.

All critical function parts, such as the core yoke 5, the armature 8, the leaf spring 10, and the cooperating contact 14, are designed to be generally planar, having their respective principle planes arranged perpendicular to the plane of integration of the relay, so that a relay is provided which is simple to manufacture and has a very narrow structure. The terminal elements 14*a*, 16, 18, and 19 are all formed as tabs and arranged in a common plane. The relay, thus, requires only a very small integration width, i.e. when it is mounted, such as on a circuit board. The terminal elements 14*a*, 18, and 19 are disposed in corresponding recesses of the coil member 1 and are also aligned by a housing 20.

In FIG. 3, the housing 20 is shown formed of two housing halves, or parts, 21 and 22 which define a parting plane between the two housing halves that extends through the common plane of the terminal elements. Respective recesses 23 for accepting the terminal elements 14*a*, 16, 18, and 19 are formed in the floor, or bottom portion, 21*a* and 22*a* of the respective housing halves 21 and 22. The recesses 23 fix and align the individual terminal elements. The terminal element 16, which is not fixed in the coil member, is held in this way and aligned in the proper position only by the housing 20. Each of the housing halves 21 and 22 include a gripping depression 24 formed into the side walls to facilitate the removal of the relay, such as from a socket (not shown). The housing halves 21 and 22 can also be formed in one part and be hinged together at an upper edge by means of a film hinge.

The relay, as shown in FIGS. 1, 2, and 3, can be expanded to form a changeover contact relay in a simple way without having to modify the basic design. FIGS. 4, 5, 6, 7, and 8 show an embodiment of a changeover contact relay. This embodiment, essentially uses the same parts as the preceding exemplary embodiment, and so the same reference characters have been used. Consequently, insofar as the two embodiments coincide a repartition of the detailed description is not repeated.

Figure 4:
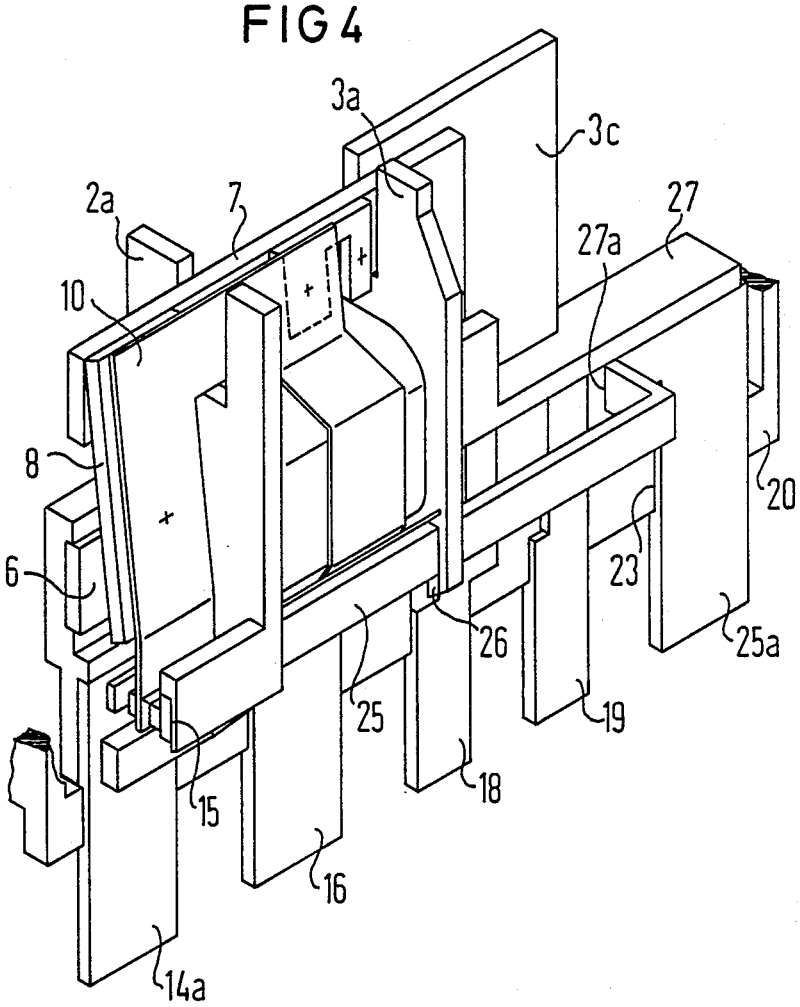
FIG. 4 is a perspective view of a modified relay of the present invention which forms a switch-over contact.

The relay of FIG. 4, in comparison to the preceding embodiment. has a second cooperating contact element 25 with a free end disposed opposite the contact spring 10*c* and supported against the seating wall 15, the seating wall 15 varying slightly in design from the preceding example. The cooperating contact element 25 extends rod-like parallel to the axis of the coil along the entire side of the relay, being guided in guide channels 26 extending through the two coil flanges 2 and 3. The coil body flange 3 includes a further continuation 27 for guiding the cooperating contact element 25, and in particular, a terminal element 25*a* of the cooperating contact element 25. Moreover, the housing 20 is correspondingly lengthened and is provided with an additional recess 23 for accepting the tab-shaped terminal element 25*a*.

Figures 5, 6, 7, 8:
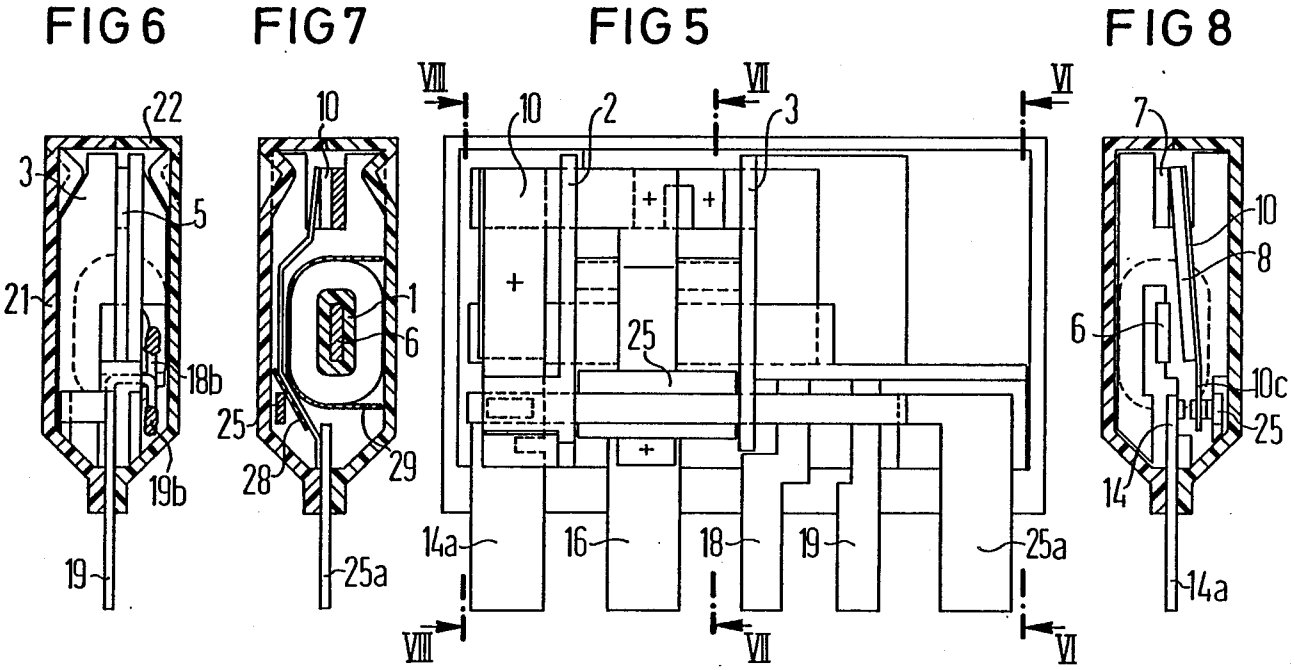
FIG. 5 is a side elevational view of the relay of FIG. 4.
FIG. 6 is a cross section of the relay shown in FIG. 5 along line VI—VI.
FIG. 7 is a cross section of the relay shown in FIG. 5 along line VII—VII.
FIG. 8 is a cross section along line VIII—VIII of the relay shown in FIG. 5.

In FIG. 7 can be seen a foil 28 provided for insulating the terminal spring leg 10*d*. A corresponding insulating foil 29, also shown in FIG. 7, provides insulation between the spring leg 10*d* and the ooil winding 1. The insulating foils 28 and 29 are also expediently provided in the preceding example of FIGS. 1 through 3.

Figure 9:
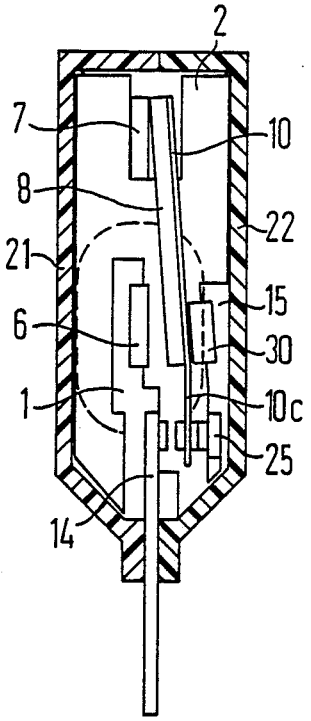
FIG. 9 is a cross section of a relay of the present invention including a switch-over contact and an additional adhesion magnet.

Another modification of the present relay is shown in FIG. 9, which is a cross section corresponding to the view of FIG. 8. The relay of FIG. 9 includes an additional adhesion magnet 30 secured in the seating wall 15 of the coil body. The adhesion magnet 30 damps the vibration of the armature 8 to prevent chattering at the break-contact, which in the present case is the cooperating contact element 25. Simultaneously, the contacting force in the quiescent position of the armature 8 is also assured by the adhesion magnet 30. The adhesion magnet 30, of course, can be used in all embodiments of the present relay. The adhesion magnet 30 provides a delayed response of the relay since it initially opposes the excitation thereof and, thus, guarantees a faultless pull-through of the armature 8 without what is referred to as creeping contacting.

The housing halves 21 and 22 are connected to one another, for example, by either ultrasound welding or heat coining.

Figure 10:
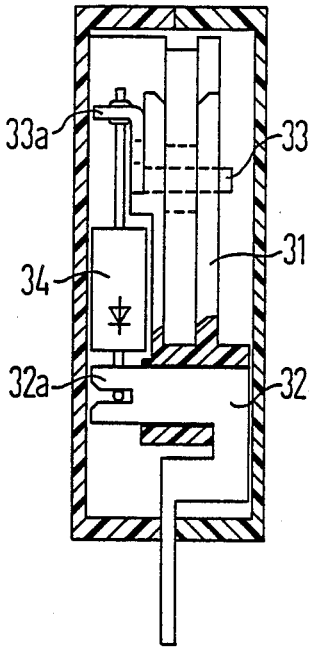
FIG. 10 is a cross section of a relay of the invention including a diode inserted into the excitation circuit.

In addition, however, circuit components, such as resistors or diodes, can also be accommodated within the housing 20. The components are connected, for example, either in parallel with the excitation winding 4 or in series therewith. FIG. 10 depicts an arrangement of a diode connected in series with the excitation winding. The illustrated relay of FIG. 10 is a slightly modified version corresponding to the view of FIG. 6. A somewhat modified coil body 31 is shown including a plug-in coil terminal element 32 and an additional winding support element 33 plugged into the upper region of the coil body 31. A diode 34 is inserted between the ends 32*a* and 33*a* of the corresponding terminal elements 32 and 33, by a standard connected method such as pinch/blade connections or solder connections. For a series connected diode 34, one winding end is connected to the terminal element 33*a*, while the other winding end is connected to a further terminal element (not shown). For a parallel connection, the structural elements are correspondingly differently designed and arranged.

Referring now to FIGS. 11, 12, 13, 14, and 15, the relay includes a carrying element in the form of a coil body 51 having two flanges 52 and 53 between which a winding 54 is applied. A U-shaped core yoke 55 is plugged into the coil body 51 so that the lower leg forms a core 56 extending in an axial direction through the coil and the upper leg forms a yoke 57 extending parallel to the coil axis above the winding 54. A flat armature 58 is seated at a free end section 57*a* of the yoke 57 to form a working air gap 59 with the free end portion 56*a* of the core 56.

An angled leaf spring 60 serves as a bearing for the armature 8, the leaf spring 60 having a first leg 60*a* resting on the armature 58 and being connected thereto and having a second leg 60*b* extending essentially parallel to the yoke 57 and being secured to a connecting angle 61. The connecting angle 61 is multiply angled and crimped, as shown in the disembodied illustration of FIG. 14. A part 61*a* lying essentially parallel to the yoke 57 has a fastening tab 61*b* cut therefrom to which the spring 60 is secured by resistance welding, the tab 61*b* being bent to form the bias angle. A part 61*c* of the connecting angle 61 extends essentially perpendicular to the plane of integration of the relay, extending around the core end 56*a* by crimping. As a result, load current is conducted once around the core 56 through the connecting angle 61 and the spring 60 so that the coil excitation is intensified by the winding of the load current when closing the make-contact. This significantly increases the switching reliability of the relay. The connecting angle 61 has a tab terminal 61*d* formed at its free end. The connecting angle 61 also includes an applied fastening plug 61*e* which is anchored in a plug-in shaft 62 of the coil body 51. Barbs 61*f* extending adjacent the end of the fastening plug 61*e* secure the conneoting angle 61. Similarly, barbs (not shown) are also provided at other plug-in parts.

Each of the two coil flanges 52 and 53 have plug-in shafts and slots for fastening further parts. A plug-in shaft 63 for fastening a connecting angle 64 is provided in the coil body flange 52, the connecting angle 64 carrying a make-contact cooperating contact element 64*a*. A tab 64*b* extends toward the bottom of the relay. A further terminal element 66, which is anchored in plug-in shafts 65, includes a break-contact piece 66*a* and a downwardly extending tab 66*b*. The terminal element 66, however, can also be formed shortened by the end portion 66*c* and be provided with a spring contact portion 66*d* welded thereon. This is shown schematically in FIG. 12. In this case, the contact member 66*a* is attached to the spring portion 66*b*.

Figure 13:
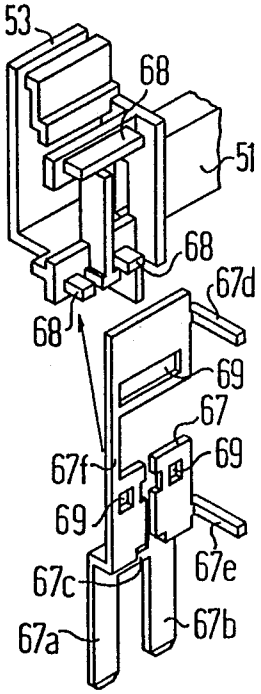
FIG. 13 is a perspective view of an end of the coil member, together with the coil terminal elements, shown in a view turned 180° with respect to FIG. 12.
Figure 12:
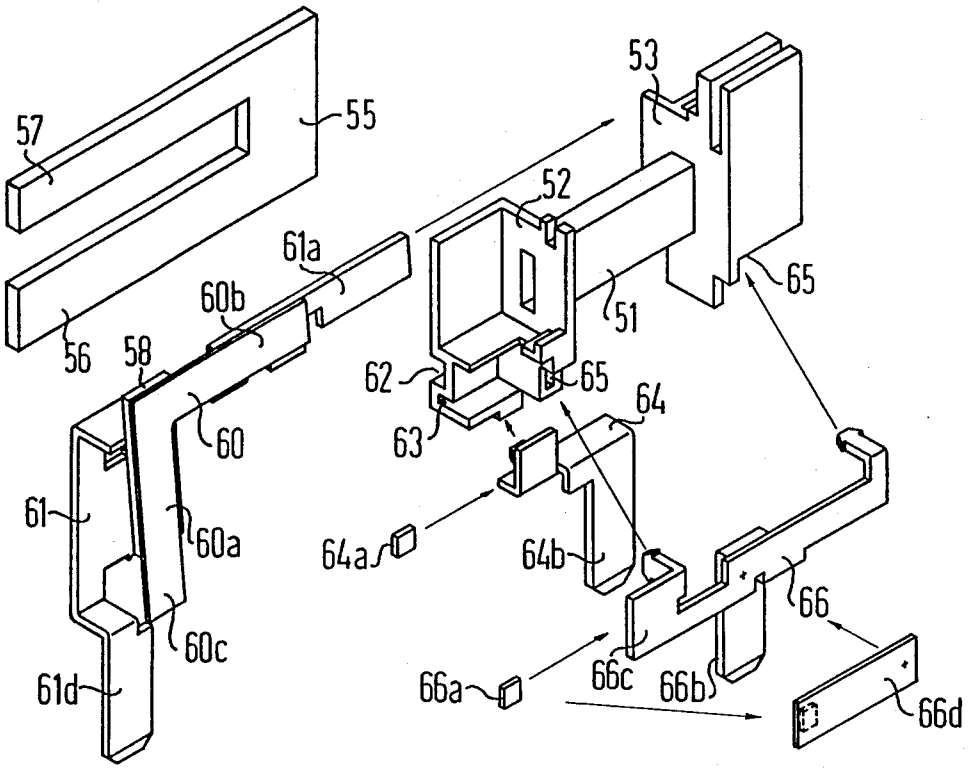
Figure 14:
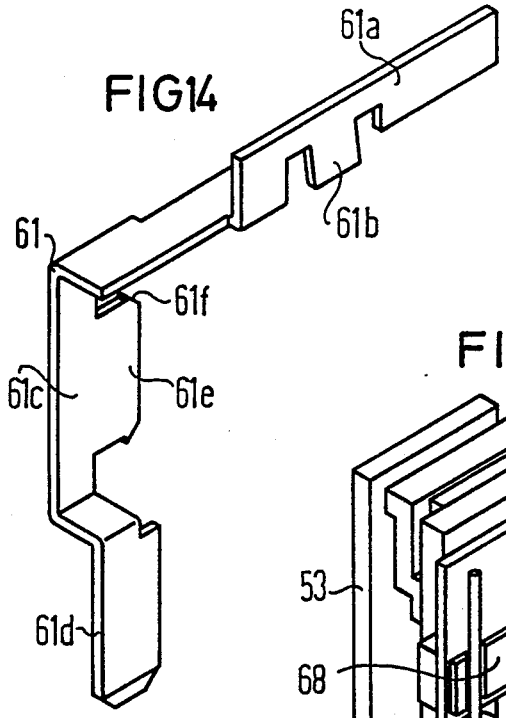
FIG. 14 is a perspective detailed illustration of an armature connecting angle from FIG. 11.
Figure 15:
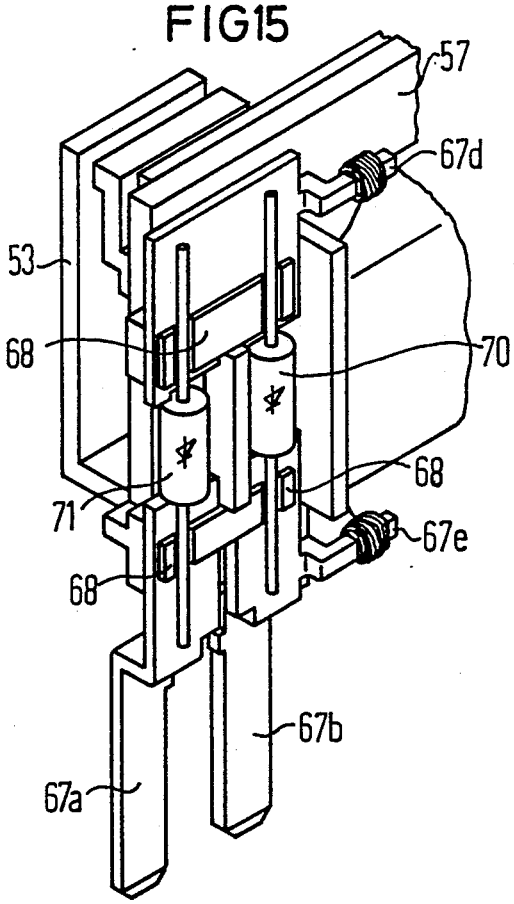
FIG. 15 is a perspective view of an end of the coil member of FIG. 11 having attached coil terminal elements and component parts.

In FIGS. 13 and 15, the coil terminal elements are formed by a correspondingly punched and shaped plate bar 67. A lower portion of the plate bar, or plate, 67 includes tab terminals 67*a* and 67*b*. The plate 67 is laterally plaoed onto the coil body flange 53, as shown in FIG. 3, in such a way that salient plastic ribs 68 engage into corresponding recesses 69 of the plate 67. The plate 67 is fixed by deforming the plastic ribs 68, such as by ultrasound or by heat coining. It is also possible, however, to embed the plate 67 when extruding the plastic coil body 51.

After fastening the plate 67, connecting tab 67*c* which extend between the two tab terminals 67*a* and 67*b* is cut out so that the two terminals are electrically separate from one another. In order to fasten a wire winding connection for the coil, two wrapping pins 67*d* and 67*e* are provided, bent over in the direction toward the coil winding 54 after the winding wire has been fastened. The winding wires are shown in FIG. 15 fastened to the wrapping pins 67*d* and 67*e*, for example, by soldering.

When an electrical component, such as a diode 70, is to be connected in parallel to the coil winding 54, the component 70 is welded to upper and lower portions of the plate 67, as shown in FIG. 15. When an electrical component, for example, a diode 71 or a resistor, is to be connected in series preceding the coil winding 54, then a web portion 67*f* which connects the upper and lower portions of the plate 67 is cut out. The component part is then welded to the upper and lower parts of the plate 67 in accordance with FIG. 15.

Figure 11:
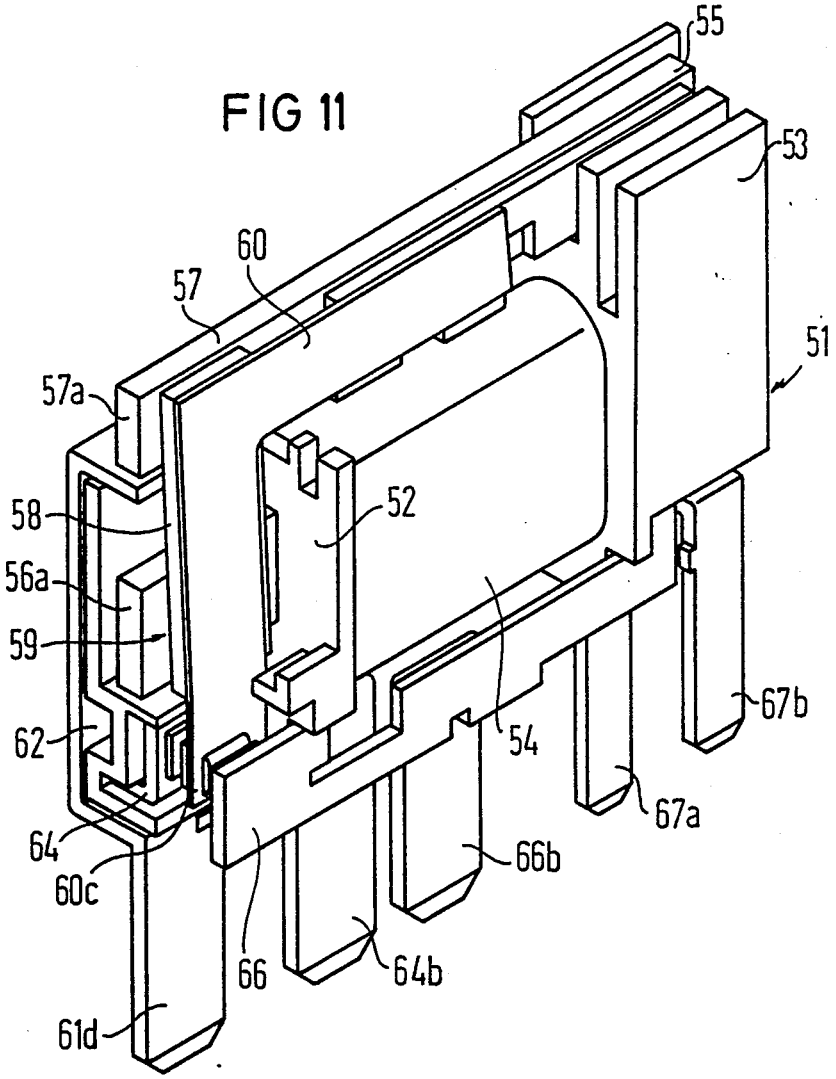
FIG. 11 is a perspective view of another embodiment of the present relay shown without the housing.

Referring now to FIG. 11, the angled leaf spring 60 forms a contact spring 60*c* by its longer portion, the contact spring 60*c* cooperating with the make-contact piece 64*a* or with the break-contact piece 66*a*, or with both depending upon the design of the relay. When increased loads are to be switched, an additional stranded copper conductor is welded on over the spring between the connecting angles and the switch contact, it is not being illustrated in detail.

Figure 16:
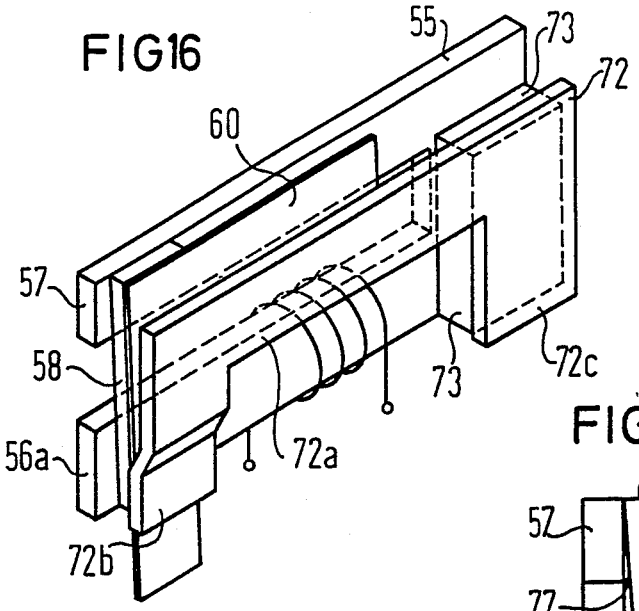
FIG. 16 is a perspective view in schematic illustration of a magnetic circuit including a permanent magnet for the present relay of FIG. 1.

The magnetic system of the present relay is shown in FIG. 16 in schematic illustration to include the possibility of providing a polarized magnet in the relay system. A U-shaped flux plate 72 is also inserted in the coil body, the flux plate 72 having a middle portion 72*a* extending parallel to the yoke 57. A first leg 52*b* of the flux plate 52 lies opposite the core end 56*a* and forms a further working air gap with the armature 58. A second leg 72*c* is anchored in the coil flange 53. A permanent magnet 73 is disposed between the core yoke 55 and the flux plate leg 72*c*. The break-contact contacting force is increased and chattering at the break-contact is reduced by the addition in the magnetic circuit of the permanent magnet 73, the yoke 57, the armature 58, and the flux plate 72.

In the illustrated embodiment, the terminal parts are in the shape of tabs. Of course, pin connections (not shown) can be provided instead for integrating the present relay on a printed circuit board. The pin terminals are capable of being bent over to integrate the relay in a prone position since they all lie in a single row.

Figure 18:
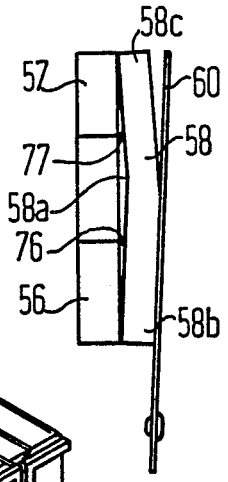
FIG. 18 is an end elevational view showing details of an armature of the relay including a yoke and a core.
Figure 17:
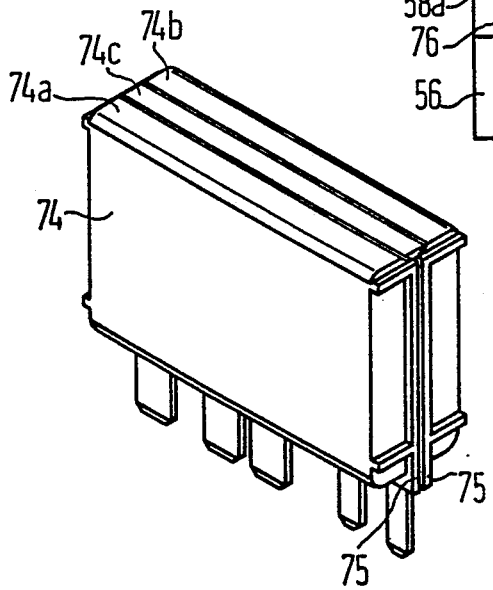
FIG. 17 is a perspective view of the relay of FIG. 11 enclosed in a housing.

FIG. 17 shows the relay enclosed within a housing 74. Two half shells 74*a* and 74*b* of the housing 74 are formed in a single piece and include a film strip hinge 74*c*. After introducing the equipped coil body thereinto, the housing 74 is closed by being hingedly moved together. Edges 75 lie against one another and are connected by ultrasound welding or heat coining. Lastly, FIG. 18 shows an advantageous design of the armature 58. The armature is slightly crimped or bent in a middle region 58*a* so that its ends 58*b* and 58*c* extend toward the coil 56 and toward the yoke 57 at a small angle. Wedge-shaped gaps 76 and 77, respectively, are formed thereby. This assures that the armature 58 always rests against the outer edges of the core and the yoke so that more favorable lever conditions take effect. Fabrication is thus facilitated, since the armature pivot point and the lever conditions remain the same even when the yoke and the core are not exactly parallel. In other words, there is less strict demands for tolerance variations.

Although other modifications and changes may be suggested by those skilled in the art, it is the intention of the inventor to embody within the patent warranted hereon all changes and modifications as reasonably and properly come within the scope of his contribution to the art.

I claim as my invention:

1. An electromagnetic relay, comprising:

a coil winding applied to a coil body having a coil axis extending parallel to a plane of integration of said relay;

two coil flanges having said coil body therebetween;

a U-shaped flat core yoke having a principle plane extending perpendicular to said plane of integration, a portion of said yoke being disposed above said coil winding, a first leg of said core yoke extending through said coil body in an axial direction as a core, a second leg of said core yoke proceeding outside of said coil as a yoke;

a plate-shaped armature seated at a free end of said yoke and forming a working air gap with a free end of said core;

an angled leaf spring secured to said yoke and to said armature, said leaf spring having a portion extending beyond a free armature end to form a contact spring;

a first terminal element connected in electrically conductive fashion to said leaf spring;

second and third coil terminal elements;

plug-in channels in said coil body for fastening said second and third terminal elements;

at least one cooperating contact element provided in said coil body; and all of said terminal elements being conducted in one plane toward outside said relay perpendicularly to a connecting plane of said relay.

2. An eleotromagnetic relay as claimed in claim 1, wherein said leaf spring includes a leg disposed parallel to said yoke, and further comprising:

a U-shaped adjustment piece securing said yoke to said leaf spring, said adjustment piece having a first leg secured flat to said yoke and a second leg carrying said leaf spring jogged by a prescribed bias angle relative to said yoke.

3. An electromagnetic relay as claimed in claim 1, wherein said two flanges include walls extending toward an outside of said relay, said walls forming guide slots for said yoke.

4. An electromagnetic relay as claimed in claim 1, wherein one of said two coil flanges facing said armature includes a plug-in shaft in the region of said contact spring; and further comprising:

a make-contact cooperating contact element accepted within said plug-in shaft.

5. An electromagnetic relay as claimed in claim 1, wherein one of said coil flanges opposite said armature is provided with plug-in shafts for accepting said second and third coil terminal elements.

6. An electromagnetic relay as claimed in claim 1, wherein said first terminal element for said leaf spring is disposed in a region under said coil winding.

7. An electromagnetic relay as claimed in claim 6, wherein said leaf spring includes a terminal portion at a portion connected to said yoke, said terminal portion of said leaf spring extending up to said first terminal element laterally embracing said coil winding.

8. An electromagnetic relay as claimed in claim 1, further comprising:

a flexible conductor element connecting said contact spring of said angled leaf spring to said first terminal element.

9. An electromagnetic relay as claimed in claim 1, further comprising:

a lengthening on one of said coil flanges opposite said armature;

a second cooperating contact element having a terminal element accepted in recesses in said lengthening;

guide shafts being formed in both said two coil flanges in which said second cooperating contact element is guided rod-like.

10. An electromagnetic relay as claimed in claim 9, further comprising:

insulating foil disposed between said second cooperating contact element and said first terminal element for said contact spring.

11. An electromagnetic relay as claimed in claim 1 further comprising:

a two-part housing defining a parting plane between the housing parts, the parting plane being aligned in the plane of said terminal elements; and guide channels formed in at least one of said housing parts for said terminal elements.

12. An electromagnetic relay as claimed in claim 11, wherein said housing parts each include lateral grasping depressions.

13. An electromagnetic relay as claimed in claim 1, further comprising:

an adhesion magnet lying opposite a free end of said armature at one of said coil flanges.

14. An electromagnetic relay as claimed in claim 1, further comprising:

additional supporting elements provided at said coil body; and additional component parts for connection to said coil winding by said additional supporting elements.

15. An electromagnetic relay as claimed in claim 1, wherein individual parts of said relay are connected to said coil body by straight line plugging.

16. An electromagnetic relay as claimed in claim 15, further comprising:

barbs formed at at least one part of end portions plugged into said coil body.

17. An electromagnetic relay as claimed in claim 15, further comprising:

a connecting angle secured to said armature above said leaf spring and being formed as a terminal element in a part extending essentially perpendicular to said yoke, said connecting angle carrying said leaf spring in a part lying essentially parallel to said yoke.

18. An electromagnetic relay as claimed in claim 15, wherein said portion of said connecting angle extending parallel to said yoke includes a fastening tab welded to said leaf spring.

19. An electromagnetic relay as claimed in claim 17, further comprising:

a plug-in shaft of said coil body secured to said connecting angle by a fastening plug portion of said connecting angle.

20. An electromagnetic relay as claimed in claim 17, wherein said perpendicular portion of said connecting angle is formed around a portion of said coil core projecting out of said coil body.

21. An electromagnetic relay as claimed in claim 15, further comprising:

a plate forming said coil terminals and having openings; and projections extending from said coil body onto which are plugged said openings of said plate, said coil terminals being insulated from one another by a cut-out web.

22. An electromagnetic relay as claimed in claim 21, wherein said projections extending from said coil body are deformed by heat.

23. An electromagnetic relay as claimed in claim 21, further comprising:

a two-poled electrical component having terminals seoured to mutually separate ones of said coil terminals.

24. An electromagnetic relay as claimed in claim 21, wherein one of said coil terminals includes a selectively removable web, and an additional component bridging one of said coil terminals interrupted by removal of said removable web.

25. An electromagnetic relay as claimed in claim 15, further comprising:

a U-shaped flux plate anchored to said coil body by plug-in fastening in said two coil flanges, a middle portion of said flux plate extending parallel to said yoke, a first leg of said flux plate extending essentially parallel to said armature and forming a second working air gap with said armature lying opposite said free end of said core, a second leg of said flux plate secured in an opening in one of said coil flanges opposite said armature; and a permanent magnet disposed between said second leg of said flux plate and said core yoke.

26. An electromagnetic relay as claimed in claim 15, further comprising:

a housing formed of two half shells connected by a film hinge and connected at mutually abutting edges by heat deforming, said housing enclosing said coil body and said plug-in parts.

27. An electromagnetic relay as claimed in claim 15, wherein said armature has respective opposite ends bent slightly toward said yoke and said core.

28. An electromagnetic relay, comprising:

a coil member including a winding between first and second generally parallel flanges;

a U-shaped flat core yoke having first and second generally parallel legs, said first leg extending through said winding to form a core of said coil member, said second leg extending parallel to said winding outside said coil member to form a yoke;

an adjustment piece having first and second portions at an angle relative to one another, said first portion being affixed to said yoke;

a leaf spring having first and second legs at approximately a right angle to one another, said first leg of said leaf spring being affixed to said second portion of said adjustment piece;

a flat armature carried on said second leg of said leaf spring and seated at a free end of said yoke, said armature forming a working air gap with a free end of said core;

cooperating contacts movable into and out of contact by movement of said armature; and a plurality of terminals extending from said relay in a single plane, one of said terminals being electrically connected to one of said cooperating contacts, a pair of said terminals being electrically connected to said winding, said terminals lying generally in the same plane as said core yoke so that a narrow relay structure results.

29. An electromagnetic relay as claimed in claim 28, further comprising:

second cooperating contacts operable by said armature and being opposed to said cooperating contacts;

a further terminal extending from said relay in the same plane as said plurality of terminals; and means for electrically connecting said second cooperating contacts to said further terminal.

30. An electromagnetic relay as claimed in claim 28, further comprising:

an adhesion magnet disposed adjacent said armature for magnetically damping vibration of said armature.

31. An electromagnetic relay as claimed in claim 28, wherein one of said terminals is formed in a single piece with said adjustment piece.

32. An electromagnetic relay as claimed in claim 28, further comprising:

a flux plate having a first portion extending generally parallel to said yoke and a second portion opposite said armature from said free end of said core to form a second working air gap.

* * * * *